US008653920B2

(12) United States Patent
Huang et al.

(10) Patent No.: US 8,653,920 B2
(45) Date of Patent: Feb. 18, 2014

(54) SUPERCONDUCTING MAGNETS WITH AN IMPROVED SUPPORT STRUCTURE

(75) Inventors: Xianrui Huang, Clifton Park, NY (US); Yan Zhao, Shanghai (CN); Pan Jun, Shanghai (CN); Paul St. Mark Shadforth Thompson, Stephentown, NY (US); Evangelos Trifon Laskaris, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 28 days.

(21) Appl. No.: 13/023,961

(22) Filed: Feb. 9, 2011

(65) Prior Publication Data

US 2011/0193665 A1 Aug. 11, 2011

(30) Foreign Application Priority Data

Feb. 9, 2010 (CN) ..... 2010 1 0109498

(51) Int. Cl.
*H01F 1/00* (2006.01)
*H01F 6/00* (2006.01)

(52) U.S. Cl.
USPC ..... 335/216

(58) Field of Classification Search
USPC ..... 335/216
See application file for complete search history.

(56) References Cited

U.S. PATENT DOCUMENTS

| | | | | |
|---|---|---|---|---|
| 4,682,134 | A * | 7/1987 | Laskaris | 335/215 |
| 4,902,995 | A * | 2/1990 | Vermilyea | 505/211 |
| 5,237,300 | A * | 8/1993 | Ige et al. | 335/299 |
| 5,530,413 | A * | 6/1996 | Minas et al. | 335/216 |
| 5,708,405 | A | 1/1998 | Moriyama et al. | |
| 7,053,740 | B1 * | 5/2006 | Laskaris et al. | 335/216 |
| 7,449,889 | B1 | 11/2008 | Huang et al. | |
| 7,498,814 | B1 | 3/2009 | Huang et al. | |
| 7,522,027 | B2 * | 4/2009 | Calvert et al. | 335/299 |
| 8,106,736 | B2 * | 1/2012 | Calvert | 335/299 |
| 2007/0152785 | A1 * | 7/2007 | Calvert et al. | 335/216 |
| 2007/0152789 | A1 * | 7/2007 | Watanabe et al. | 335/216 |
| 2007/0247263 | A1 | 10/2007 | Calvert et al. | |
| 2009/0128270 | A1 | 5/2009 | Calvert et al. | |

FOREIGN PATENT DOCUMENTS

| | | | |
|---|---|---|---|
| GB | 2437114 | A | 10/2007 |
| JP | 2005030781 | A | 2/2005 |
| JP | 2008034525 | A | 2/2008 |

OTHER PUBLICATIONS

U.S. Appl. No. 11/930,953, entitled "Magnet Assembly for Magnetic Resonance Imaging System" and filed Oct. 31, 2007.

* cited by examiner

*Primary Examiner* — Alexander Talpalatski

(74) *Attorney, Agent, or Firm* — Global Patent Operation; Mark A. Conklin

(57) ABSTRACT

A superconducting magnet is described and includes at least one superconducting coil, at least one support member coupled to the superconducting coil and at least one compliant interface between the superconducting coil and the support member. The superconducting coil defines a radial direction. The superconducting coil supports the superconducting coil along an axial direction that is substantially perpendicular to the radial direction. The compliant interface is configured to move along the radial direction when the superconducting magnet is energized.

7 Claims, 5 Drawing Sheets

SUPERCONDUCTING MAGNETS WITH AN IMPROVED SUPPORT STRUCTURE

BACKGROUND

The invention generally relates to superconducting magnets, and more particularly to superconducting magnets with an improved support structures for supporting superconducting coils.

Superconducting magnets are used in many applications, such as magnetic resonance imaging systems and cyclotron magnet systems. Superconducting magnets generally have a plurality of superconducting coils for generating a magnetic field and one or more support members for supporting superconducting coils. The "superconducting coil" is referred to as "coil" hereinafter for simplicity.

When the superconducting magnets are energized, the coils produce axial electro-magnetic (EM) forces and radial EM forces. The one or more support members are used for supporting the coils against the axial EM forces. The radial EM forces are generally accounted for by the coils' own hoop stresses, which result in hoop strains and radial expansions in the coils. Such radial expansions of the coil can cause frictional movements at the contact interfaces between the coils and the one or more support members. The frictional movements generate heat, which can quench the coils and lead to magnet instability of the superconducting magnets. This is particularly noticeable at low temperatures, such as liquid helium temperature, since the coils have very small thermal capacity and a small thermal disturbance can raise the temperatures of the coil to exceed its threshold, causing the coil to quench.

Some conventional superconducting magnets allow some frictional movements at the contact interfaces by having more superconducting or normal metal materials in the coils to absorb the thermal disturbances. However, superconducting materials are expensive and adding more material in the coils results in the increased production cost. In another conventional superconducting magnet, the coils are directly bonded to the support structure. The bonding strength at bonding interfaces makes the one or more support members move together with the coils. However, inconsistent movements can cause cracks at the bonding interfaces, which results in thermal disturbances to the coils.

Therefore, there is a need to provide superconducting magnets with an improved support structure to achieve better magnet stability.

BRIEF DESCRIPTION

In accordance with one embodiment, a superconducting magnet comprises at least one superconducting coil, at least one support member and at least one compliant interface interposed between the superconducting coil and the support member. The superconducting coil defines a radial direction. The support member is coupled to the superconducting coil and supports the superconducting coil along an axial direction that is substantially perpendicular to the radial direction. The compliant interface provides for movement along the radial direction when the superconducting magnet is energized.

In accordance with another embodiment, a superconducting magnet comprises at least one superconducting coil defining a radial direction, and at least one support member supporting the superconducting coil along an axial direction that is substantially perpendicular to the radial direction. The support member comprises a compliant portion that is affixed to the superconducting coil and configured to produce a radial movement corresponding to a movement with the superconducting coil when the superconducting magnet is energized.

In accordance with another embodiment, a superconducting magnet comprises a plurality of superconducting coils, a plurality of support rings and a plurality of support bars. The superconducting coils are spaced apart from each other in an axial direction. The support rings are respectively coupled to outer diameter surfaces of the superconducting coils. Each support bar is affixed to outer diameter surfaces of the support rings for axially supporting the support rings.

These and other advantages and features will be further understood from the following detailed description of embodiments of the invention that are provided in connection with the accompanying drawings.

DETAILED DESCRIPTION

Embodiments of the present disclosure will be described hereinbelow with reference to the accompanying drawings. In the following description, well-known functions or constructions are not described in detail to avoid obscuring the disclosure in unnecessary detail.

Figure 1:
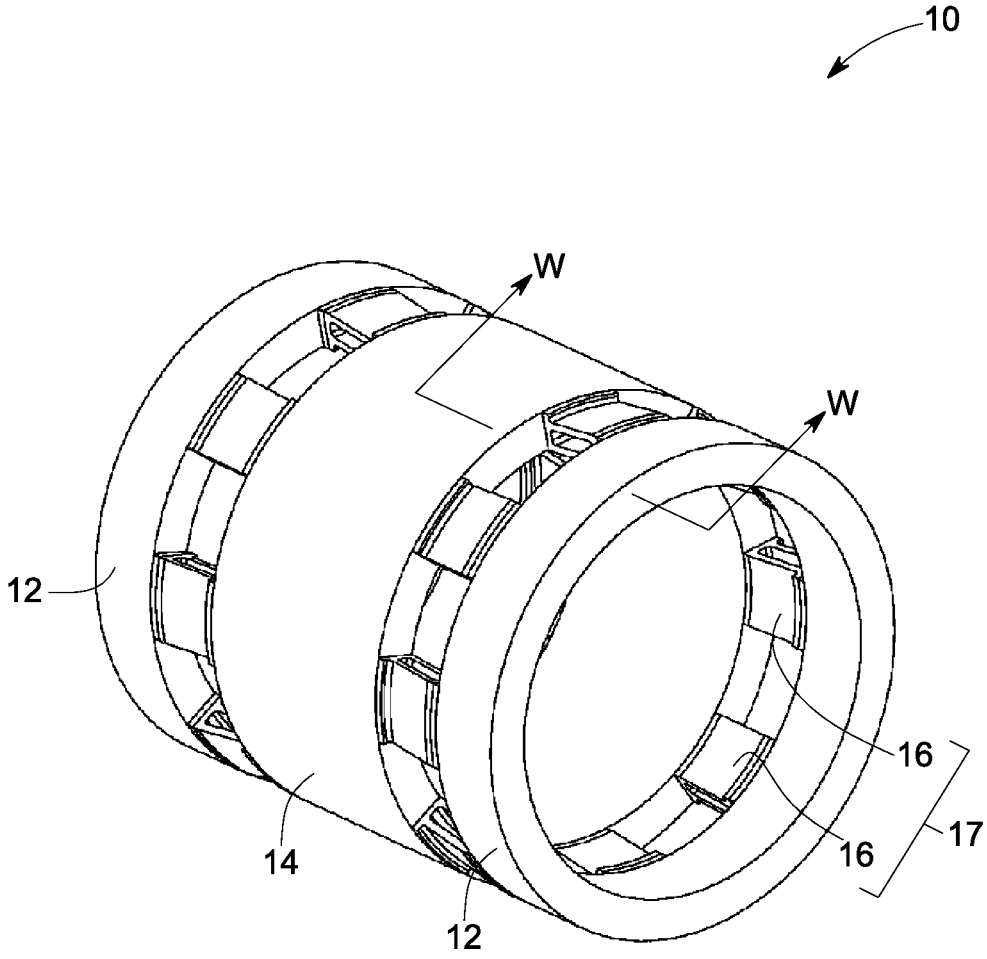
FIG. 1 is a schematic perspective view of a superconducting magnet in accordance with one embodiment of the invention.

FIG. 1 illustrates a superconducting magnet 10 in accordance with one embodiment of the invention. The superconducting magnet 10 includes two coils 12 separately positioned along an axial direction and a support member 14 interposed about the two adjacent coils 12 to provide axial support. In one embodiment, the coils 12 and the support member 14 are cylindrical and axially aligned and concentric with each other. In still another embodiment, the superconducting magnet 10 includes a plurality of sections each of which has a similar configuration as shown in FIG. 1.

In this example there is a compliant interface 17 interposed between the coils 12 and the support member 14 wherein the compliant interface 17 is configured to accommodate the radial movement of the coils 12 to minimize or eliminate frictional movements and thermal disturbances when the superconducting magnet 10 is energized. Furthermore, the material used for manufacturing the compliant interface 17 is less costly than materials directly added on the coils, so the superconducting magnet 10 with the compliant interface 17 will not increase the production cost.

Figure 2:
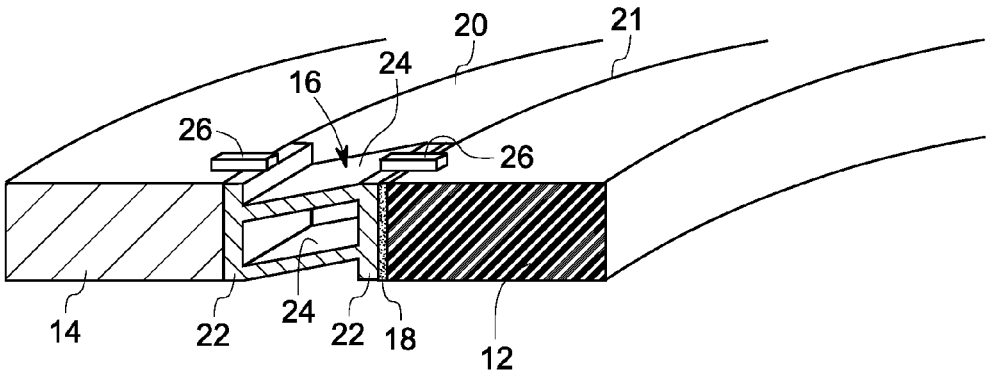
FIG. 2 is a partial perspective view of the superconducting magnet taken along the line w-w in FIG. 1.

Referring to FIGS. 1 and 2, the superconducting magnet 10 in this example includes the compliant interface 17 which cooperates with the support member 14 to form the total support structure of the superconducting magnet 10. The compliant interface in this example includes a plurality of compliant blocks 16 (see FIG. 1), and a compliant layer that includes in one embodiment a plurality of compliant pads 18. The compliant blocks 16 in this example are annularly distributed on the end surface 20 of the support member 14 and equally spaced from each other. In one embodiment, the compliant blocks 16 are made of metal, such as aluminum, brass and stainless steel. The compliant pads 18 are sandwiched by the corresponding compliant blocks 16 and the end surface 21 of coil 12.

Each compliant block 16 in this example has two side plates 22 and two compliant plates 24. One side plate 22 is affixed or coupled to the end surface 20 of the support member 14, and the other side plate 22 is affixed or coupled to the compliant pads 18 and the end surface 21 of the coil 12. In one embodiment, the side plates 22 are positioned and affixed by using two blocking portions 26 as shown in FIG. 2. In FIG. 2, the two blocking portions 26 extend from top surfaces of the side plates 22 and are respectively affixed to outer diameter (OD) surfaces of the coil 12 and the support member 14. It is understood, as shown in FIG. 1, the blocking portions 26 are only one means for securing the compliant blocks 16 and complaint pads 18. In other embodiments the side plates 22 are coupled to the coils 12, the compliant pads 18 and the support member 14 by bolts, bonding agents or other suitable means.

The two compliant plates 24 extend from one side plate 22 and terminate at the other side plate 22 to be approximately parallel to and spaced from each other. In one embodiment, the two compliant plates 24 are angled with a tilt towards the coil 12. In another embodiment, there are more than two compliant plates 24. With such configuration, side plates 22 can move in parallel and the compliant plates 24 can bend toward the radial direction under an axial EM force. In addition, the various parameters of the compliant block 16 can be adjusted to make the radial displacement of the compliant block 16 to be consistent with the radial expansion of the coil 12 during operation of the superconducting magnet 10.

When the superconducting magnet 10 is energized, the coil 12 generates both axial and radial EM forces. The radial EM forces are supported by the hoop stresses of the coil 12, resulting in a radial expansion. The axial EM forces compress the compliant block 16, causing the compliant plates 24 to bend and generate a radial displacement of the side plate 22 at the coil end. The radial displacement is consistent with the coil radial expansion so that there is no frictional movement generated at the interface between the side plate 22 and coil 12, thus improving the magnet stability.

In one embodiment, the compliant pads 18 are used to further accommodate any residual differences between the radial expansion of the coil 12 and the radial displacement of the compliant block 16. In one example, the material of the compliant pads 18 is compliant at cryogenic temperatures, such as leather, although other comparable materials are within the scope of the invention.

Figure 3:
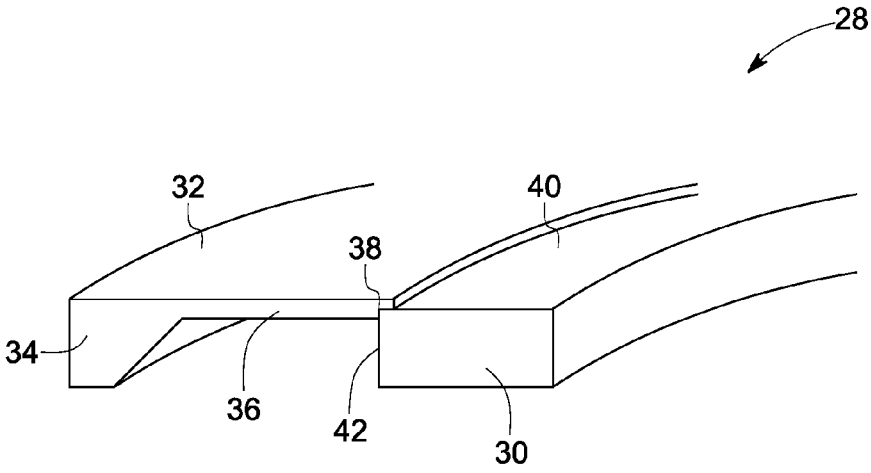
FIG. 3 is a partial perspective view of a superconducting magnet in accordance with another embodiment of the invention.

FIG. 3 illustrates a portion of a superconducting magnet 28 in accordance with another embodiment of the invention. The superconducting magnet 28 includes at least one coil 30 and at least one support member 32 for axially supporting the coil 30. In one embodiment, the coil 30 is cylindrical, which is similar with the coil 12 shown in FIG. 1.

The support member 32 in this example also has a cylindrical profile, which is similar to the support member 14 shown in FIG. 1. The support member 32 has a support portion 34, and there is an integrated interface portion called a compliant portion 36 connected with the support portion 34 and a clamping portion 38. The compliant portion 36 has a smaller thickness than the support portion 34 such that the compliant portion 36 is compliant in the radial direction. The clamping portion 38 is formed on the tip of the compliant portion 36 and affixed or coupled to an edge portion of the coil 30 to enable the compliant portion 36 to move together with the coil 30.

As shown in FIG. 3, the clamping portion 38 not only partially covers an OD surface 40 of the coil 30 but also has an extended lip that partially covers a portion of the end surface 42 of the coil 30. In one example the compliant portion 36 has a notch to facilitate the mating of the compliant portion 36 to the coil 30. When the superconducting magnet 28 is energized, the compliant portion 36 bends and produces a radial displacement in the radial direction under axial EM forces.

By adjusting various parameters of the compliant portion 36 such as thickness, material and length, the compliant portion 36 has enough compressive strength to support the axial EM forces of the coil 30 and compliant in radial bending to allow radial displacement consistent with the radial expansion of the coil 30 during the operation of the superconducting magnet 28. There is no frictional movement between the coil 30 and the support member 32, thereby improving the magnet stability.

In one embodiment, the compliant portion 36 is integrated with the support portion 34, as shown in FIG. 3. In another embodiment, the compliant portion 36 is configured to be a single member that is affixed to the support portion 34 by various means. The design and calculation of the single member is similar to the compliant portion 36.

Figure 4:
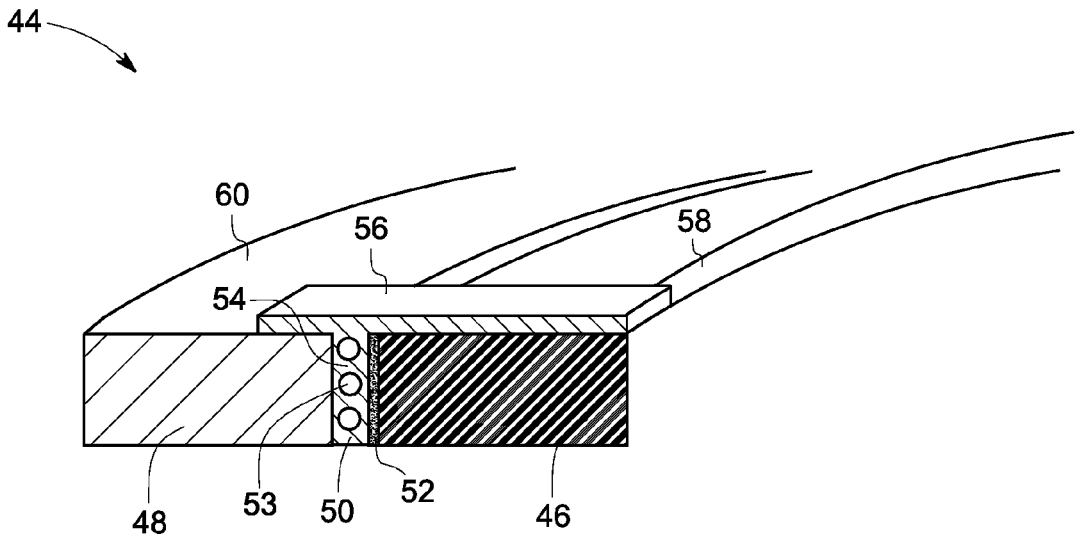
FIG. 4 is a partial perspective view of a superconducting magnet in accordance with still another embodiment of the invention.

FIG. 4 illustrates a portion of a superconducting magnet 44 in accordance with still another embodiment of the invention. The superconducting magnet 44 includes at least one coil 46, at least one support member 48 for axially supporting the coil 46, with a compliant interface between the coil 46 and the support member 48. The compliant interface is coupled to the coil 46 such that they can move together.

In one embodiment, the coil 46 and the support member 48 are cylindrical, which are similar to the coil 12 and the support member 14 shown in FIG. 1. The compliant interface in this example comprises a plurality of brackets 50 that are annularly disposed to one end surface of the support member 48 and equally spaced from each other. In one example, there are 16 such brackets 50 for a superconducting magnet with about 0.5 m radius. The number of brackets 50 can be adjusted according to the size of the superconducting magnet 44 and the magnitude of the EM forces to be supported. In one embodiment, the brackets 50 are made of metal, such as aluminum, brass and stainless steel. The compliant interface in this example also comprises a plurality of compliant pads 52 each of which is sandwiched by the corresponding brackets 50 and the coil 46. In one embodiment, the compliant pads 52 are made of leather.

Referring to FIG. 4, in one embodiment, the brackets 50 are approximately T-shaped and each includes a radial portion 54 sandwiched by the compliant pad 52 and the support member 48 and an axial portion 56 extending from a top end of the radial portion 54 to partially cover both the coil OD surface 58 and the support member OD surface 60. In the embodiment shown in FIG. 4, the brackets 50 move together with the coil 46 by affixing the axial portion 56 to the coil OD surface 58 via various affixing means such as a bonding agent.

In another embodiment, the axial portion 56 is configured not to cover any part of the support member OD surface 60. In still another embodiment, the axial portion 56 is not employed. The brackets 50 moves together with the coil 46 by affixing the radial portion 54 to the compliant pads 52 and an end surface of the coil 46 via a bonding agent or other suitable affixing means.

The bracket 50 can slide against the support member 48, and at least one of the sliding surfaces (not labeled) between them is configured to be smooth. The term "smooth" means frictional coefficients of the sliding surfaces are smaller than or equal to approximately 0.1. When the superconducting magnet 44 is energized, the coil 46 may have a radial movement, which causes a sliding movement between the bracket 50 and the support member 48. Since the sliding surfaces are smooth, a small amount of heat is generated during the sliding movement. In order to protect the coil 46 from the thermal disturbance, a cryogen such as liquid helium is can be used to cool the interface before the heat transfers to the coil 46. In one embodiment, the radial portion 54 has a plurality of the holes 53, and the thermal disturbance is mitigated by the cryogen such as liquid helium inside the holes 53.

Figure 5:
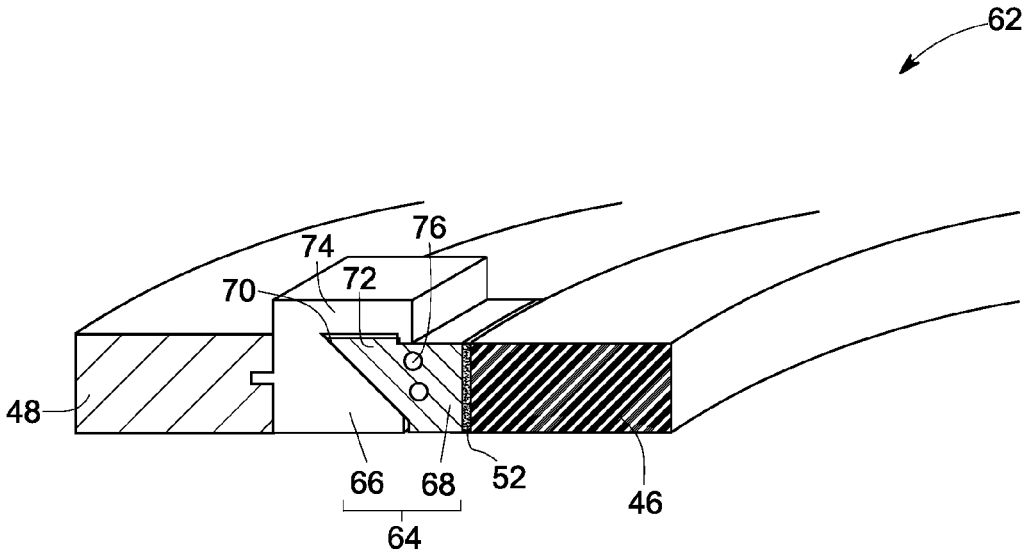
FIG. 5 is a partial perspective view of a superconducting magnet in accordance with still another embodiment of the invention.

FIG. 5 illustrates a portion of a superconducting magnet 62 in accordance with still another embodiment. The superconducting magnet 62 is similar to the superconducting magnet 44, but has a different configuration in the compliant interface. In the embodiment of FIG. 5, the interface comprises a plurality of sliding blocks 64 having an annular distribution on the end surface of coil 46. In one embodiment, the sliding blocks 64 are made of metal, such as aluminum, brass and stainless steel.

Each sliding block 64 has a first part 66 and a second part 68. The first part 66 and the second part 68 slide against each other and include sliding surfaces between them. In one embodiment, one of the sliding surfaces is smooth. In another embodiment, all the sliding surfaces are smooth. According to this example, the first part 66 is affixed to the support member 48 and the second part 68 is affixed to the compliant pads 52 and the coil 46.

The first part 66 has a wedge-groove 70 and a cantilever beam 74. The wedge-groove 70 is used for accommodating a wedge portion 72 of the second part 68. When the superconducting magnet 62 is energized, the second part 68 is pushed to produce a sliding movement in the wedge-groove 70 under axial EM forces. At the same time, reaction forces are generated to balance the axial EM force and make the cantilever beam 74 deflect to have a radial displacement. The radial displacement is consistent with the radial expansion of the coil 46 under the radial EM forces by adjusting various parameters of the cantilever beam 74 such as thickness, material and length. In this example there is no frictional movement between the coil 46 and the second part 68.

Since the sliding surfaces between the first part 66 and the second part 68 are smooth, a small amount of heat is generated during the sliding movement. Furthermore, the small amount of heat may be cooled by a cryogen such as liquid helium before it reaches the coil 46. In one embodiment, the second part 68 has a plurality of the holes 76 to hold the cryogen, such as liquid helium, for cooling.

Figure 6:
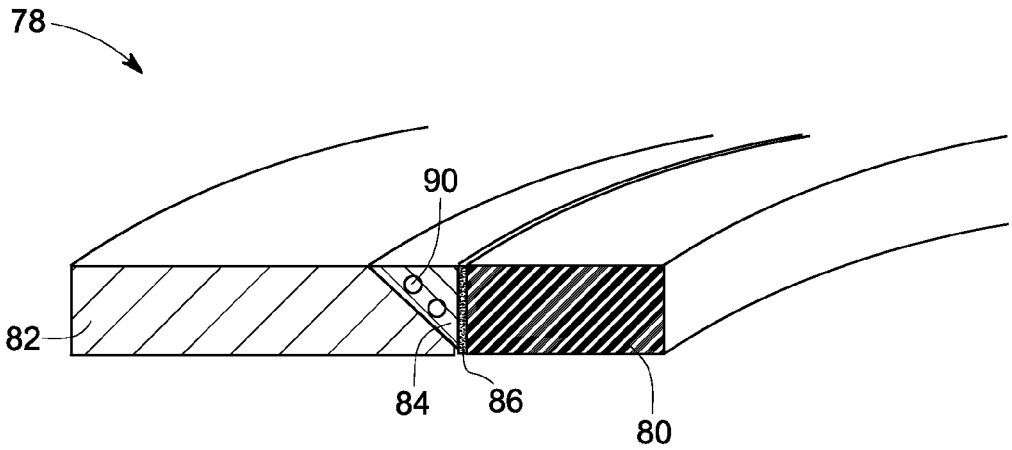
FIG. 6 is a partial perspective view of a superconducting magnet in accordance with still another embodiment of the invention.

FIG. 6 illustrates a portion of a superconducting magnet 78 in accordance with still another embodiment. The superconducting magnet 78 includes at least one coil 80, at least one support member 82 axially supporting the coil 80, a wedge ring 84 between the support member 82 and the coil 80 and a compliant ring 86 between the wedge ring 84 and the coil 80. In one embodiment, the wedge ring 84 is made of metal, such as aluminum, brass and stainless steel. In another embodiment, the wedge ring 84 is made of composite material.

The wedge ring 84 is affixed to the compliant ring 86 and the coil 80, while the wedge ring 84 and the support member 82 can slide against each other. Under axial EM forces, the wedge ring 84 has a sliding movement along a slope surface of the support member 82 to produce a radial displacement. The wedge ring 84 is configured to enable the radial displacement to be consistent with the radial expansion of the coil 80 during operation of the superconducting magnet 78 such that no frictional movement is incurred between the wedge ring 84 and the coil 80. The compliant ring 86 is employed to accommodate any small differences between the radial displacement of the wedge ring 84 and the radial expansion of the coil 80. Therefore, no cracks would occur between the wedge ring 48 and the compliant ring 86 as well as between the compliant ring 86 and the coil 80 during operation of the superconducting magnet 78.

The wedge ring 84 in this example has a sliding surface, wherein at least one of the sliding surface and the slope surface of the support member 82 is configured to be smooth, thus a small amount of heat may be generated during the sliding movement. A cryogen such as liquid helium can be used to cool the superconducting magnet 78 and remove the heat before it reaches the coil 80, thereby improving magnet stability. In one embodiment, the wedge ring 84 has a plurality of the holes 90 for holding the cryogen to enhance cooling. In this example, the wedge ring 84 and the compliant ring 86 extend circumferentially around the entire superconducting magnet 78. In one embodiment, the wedge ring 84 is replaced by isolated wedge sections annularly distributed on the end surface of the coil 80, as the distribution of the sliding blocks 64 (see FIG. 5). The compliant ring 86 is accordingly replaced by a plurality of compliant pads.

Figure 7:
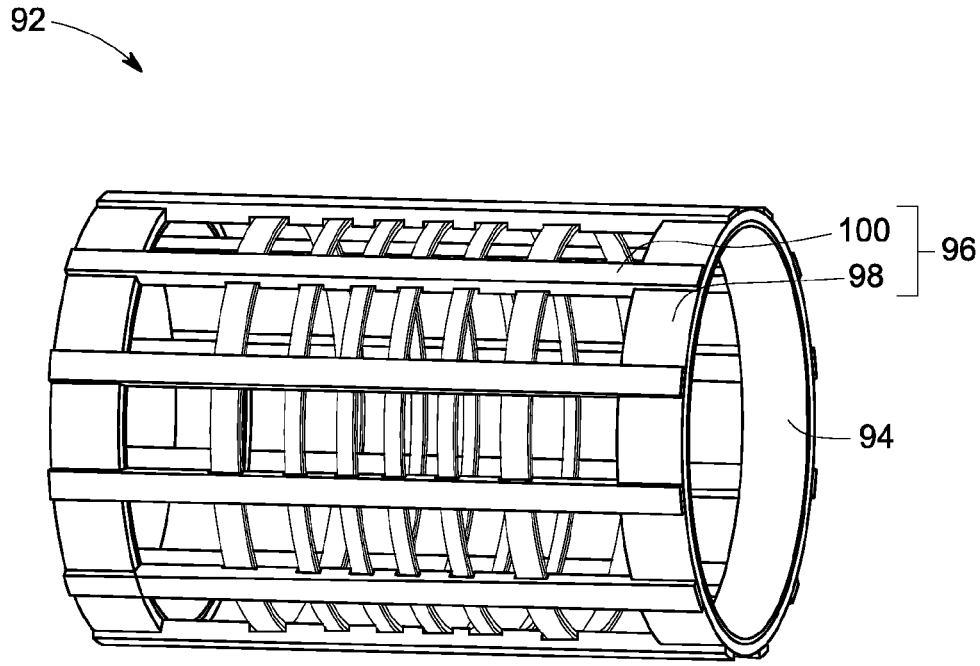
FIG. 7 is a perspective view of a superconducting magnet in accordance with still another embodiment of the invention.

FIG. 7 illustrates a superconducting magnet 92 in accordance with still another embodiment of the invention. The superconducting magnet 92 includes a plurality of coils 94 in separated locations along an axial direction and a support member 96 for holding the coils 94 in position. The support member 96 has a plurality of support rings 98 and a plurality of support bars 100. In one embodiment, the coils 94 and the support rings 98 are cylindrical.

The supports rings 98 in one example are bonded or otherwise secured to the OD surfaces (not labeled) of the corresponding coils 94. In one embodiment, the support rings 98 are made of fiberglass or carbon fiber composite material. In another embodiment, the support rings 98 are metal wires wrapping around and securing to the OD surfaces of coils 94 by an adhesive such as epoxy resin. In still another embodiment, the metal wires are aluminum, brass, or stainless steel.

Figure 8:
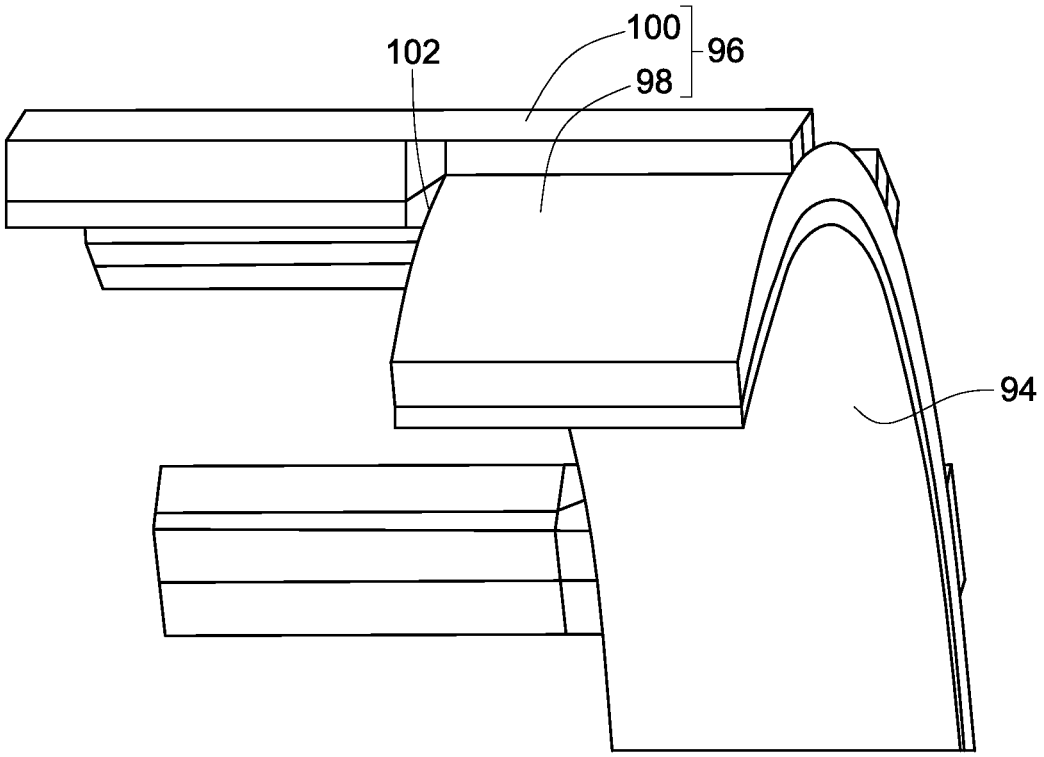
FIG. 8 is a partial perspective view of the superconducting magnet from FIG. 7.

Referring to FIGS. 7 and 8, the support bars 100 in one example are spatially parallel to each other and are annularly distributed along OD surfaces (not labeled) of the support rings 98. Each support bar 100 has a plurality of grooves 102 for partially accommodating and positioning the support rings 98 in the axial direction. In one embodiment, the support rings 98 are retained in the grooves 102 by epoxy resin or other suitable securing means. The depths of the grooves 102 in a further example are configured to be slightly less than the thickness of the support rings 98 so that the sides of the coils 94 are free from the support bars 100. In one embodiment, the support bars 100 are made of composite material or metal such as stainless, brass and aluminum.

When the superconducting magnet 92 is energized, the support rings 98 and the coils 94 both support the radial EM forces incurred on the coils 94, while the axial EM forces incurred in the coils 94 are transmitted to the support rings 98 and then to the support bars 100. The radial bending of the support bars 100 accommodates the differences in radial expansions between coils 94. Therefore, there is no frictional movement occurrence during operation by using the support rings 98 between the support bars 100 and the coils 94, which results in improved magnet stability of the superconducting magnet 92.

Although other parts and components of the superconducting magnets are not disclosed in the descriptions in the embodiments for convenience, it is understood that such description will not limit the superconducting magnets to only the cited parts. In a further example, the superconducting magnet may include a cooling pipeline or other similar cooling mechanism according to practical applications.

While only certain features of the invention have been illustrated and described herein, many modifications and changes will occur to those skilled in the art. It is, therefore, to be understood that the appended claims are intended to cover all such modifications and changes as fall within the true spirit of the invention.

What is claimed is:

1. A superconducting magnet, comprising:

at least one superconducting coil defining a radial direction;

at least one support member coupled to the superconducting coil and supporting the superconducting coil along an axial direction which is substantially perpendicular to the radial direction; and at least one compliant interface interposed between the superconducting coil and the support member; wherein the compliant interface provides for movement along the radial direction when the superconducting magnet is energized, and wherein the compliant interface comprises a plurality of compliant blocks each of which comprises two side plates abutting against two opposite end surfaces of the superconducting coil and the support member and two or more compliant plates spaced from each other and connecting the two side plates.

2. The superconducting magnet of claim 1, wherein the compliant interface is compliant, in the radial direction.

3. The superconducting magnet of claim 1, wherein the compliant plates are angled with a tilt toward the superconducting coil.

4. The superconducting magnet of claim 1, wherein the compliant plates are configured to have a radial displacement that is consistent with a radial expansion of the superconducting coils during operation of the superconducting magnet.

5. The superconducting magnet of claim 1, further comprising a compliant layer between the compliant interface and the superconducting coil.

6. The superconducting magnet of claim 5, wherein the compliant layer comprises a. plurality of leather pads.

7. The superconducting magnet of claim 2, wherein the compliant interface is made of metal.

* * * * *

UNITED STATES PATENT AND TRADEMARK OFFICE

CERTIFICATE OF CORRECTION

PATENT NO. : 8,653,920 B2
APPLICATION NO. : 13/023961
DATED : February 18, 2014
INVENTOR(S) : Huang et al.

It is certified that error appears in the above-identified patent and that said Letters Patent is hereby corrected as shown below:

In the Claims

In Column 8, Line 12, in Claim 2, delete "compliant," and insert -- compliant --, therefor.

In Column 8, Line 25, in Claim 6, delete "comprises a." and insert -- comprises a --, therefor.

Signed and Sealed this
Twenty-second Day of July, 2014

Michelle K. Lee

Michelle K. Lee
*Deputy Director of the United States Patent and Trademark Office*